US008240240B2

(12) United States Patent
Fitzkee et al.

(10) Patent No.: US 8,240,240 B2
(45) Date of Patent: Aug. 14, 2012

(54) CYLINDER POSITION SENSOR

(75) Inventors: Douglas S. Fitzkee, Ephrata, PA (US); Christopher A. Foster, Denver, PA (US); John Posselius, Ephrata, PA (US); Chris Brubaker, Leola, PA (US); Justin Ringwald, New Holland, PA (US)

(73) Assignee: CNH America LLC, New Holland, PA (US)

( * ) Notice: Subject to any disclaimer, the term of this patent is extended or adjusted under 35 U.S.C. 154(b) by 871 days.

(21) Appl. No.: 12/262,582

(22) Filed: Oct. 31, 2008

(65) Prior Publication Data

US 2010/0107869 A1 May 6, 2010

(51) Int. Cl.
*F01B 31/12* (2006.01)
*F15B 15/28* (2006.01)

(52) U.S. Cl. ..... 91/1; 92/5 R

(58) Field of Classification Search ..... 91/1; 92/5 R, 92/165 R

See application file for complete search history.

(56) References Cited

U.S. PATENT DOCUMENTS 3,650,182 A * 3/1972 Phillips ..... 92/165 R
4,061,026 A 12/1977 Goodfriend et al.
4,316,145 A * 2/1982 Tann ..... 92/5 R
4,411,577 A 10/1983 Shearer, Jr.
4,517,645 A 5/1985 Yuki et al.
4,793,241 A 12/1988 Mano et al.
4,817,733 A 4/1989 Hennecke et al.
4,829,418 A 5/1989 Nielsen et al.
5,241,278 A 8/1993 Bitar
5,455,509 A * 10/1995 Semura et al. ..... 92/5 R
5,539,993 A * 7/1996 Kilpinen et al. ..... 33/706
5,572,809 A 11/1996 Steenwyk et al.
6,509,733 B2 1/2003 Blubaugh et al.
6,690,160 B2 2/2004 Gray et al.
6,922,158 B2 7/2005 Ymker
6,941,827 B2 * 9/2005 Krone et al. ..... 73/865.9
6,989,669 B2 * 1/2006 Low et al. ..... 324/207.25
7,051,639 B2 5/2006 Krone et al.
7,116,097 B2 10/2006 Revankar et al.
7,162,947 B2 1/2007 Kucher et al.
7,178,446 B2 2/2007 Kucher et al.
2004/0222788 A1 11/2004 Low et al.
2007/0103343 A1 5/2007 Recio et al.

* cited by examiner

*Primary Examiner* — Thomas E Lazo
(74) *Attorney, Agent, or Firm* — Patrick M. Sheldrake

(57) ABSTRACT

A device for detecting the absolute position of a cylinder rod is provided. A cylinder assembly has a cylinder body with a gland member positioned thereof. The gland member has a rod opening extending therethrough. An adjustable sensor is mounted on the gland member, the adjustable sensor being operable to read one or more detectable features of the cylinder rod. The adjustable sensor can be incrementally adjusted relative to the cylinder rod to optimize the gap provided between the adjustable sensor and the cylinder rod, allowing the sensor to detect the motion and absolute position of the cylinder rod. The detectable features may be three tracks of data including first timing data and position data.

7 Claims, 6 Drawing Sheets

CYLINDER POSITION SENSOR

FIELD OF THE INVENTION

The present invention relates to a mount for a position sensor and to a method for determining the absolute position of a cylinder. In particular, the invention is directed to a cylinder assembly with a position sensor mounted thereon and to a method for determining the absolute cylinder position and the direction of motion.

BACKGROUND OF THE INVENTION

Various agricultural, construction and other industrial equipment use hydraulic cylinders to control the movement and position of the machinery. In general, the cylinder assembly has a cylinder body with a cylinder rod extending therein. The cylinder rod may be connected or secured to a piston at the one end and coupled (directly or indirectly) to a machine component at the end that extends out of the cylinder body. Fluid enters the cylinder body, causing the piston and the cylinder rod, which is secured thereto, to move relative to the cylinder body. The movement of the cylinder rod drives the motion of the machine component.

Precise control of the position of the piston is important to controlling the operation of the machinery. Measuring the absolute position or velocity of the piston relative to the cylinder is often needed to achieve the desired control.

U.S. Patent Application Publication Number 2004/0222788 describes a system and method of recording piston rod position information in a magnetic layer on the piston rod. A piston rod moving with respect to a cylinder has a magnetically hard layer formed thereon to provide a recording medium. A magnetic pattern is recorded in the magnetically hard layer. A magnetic field sensor senses the recorded magnetic pattern while the piston rod is moving with respect to the cylinder and generates signals in response to the magnetic pattern that are used to determine an instantaneous position of the piston rod. This is a relatively complicated and costly device. The magnetic pattern only allows the magnetic field sensor to sense the relative position of the piston rod, not the absolute position.

U.S. Pat. No. 7,051,639 discloses a method and apparatus for detecting the position of a rod member of a cylinder assembly. The cylinder assembly has a cylinder body with a cylinder chamber therein, a gland member disposed within the cylinder chamber, and a rod member movably arranged within the cylinder chamber and a rod opening formed in the gland member. The method includes moving the gland member within the cylinder chamber to substantially align a gland aperture of the gland member with a cylinder aperture of the cylinder body; substantially fixing the gland member relative to the cylinder body; positioning a sensor with at least one of the cylinder aperture and the gland aperture; moving the rod member within the rod opening of the gland member and the cylinder chamber of the cylinder body; and operating the position sensor to detect the position of the rod member.

U.S. Pat. No. 7,162,947 discloses a cylinder body having a first mounting portion disposed thereon. The gland member may be disposed within a gland opening formed in the cylinder body. The sensor mount has a second mounting portion disposed thereon and may be attached to the cylinder body via a coupling engagement between the second mounting portion of the sensor mount and the first mounting portion of the cylinder body. The rod member may be slidably arranged within rod openings of the sensor mount and the gland member and may extend into a longitudinal cylinder chamber of the cylinder body.

Both of these patents require the cylinder body to be modified to include the sensor. U.S. Pat. No. 7,162,947 requires that a mounting portion be provided on the cylinder body and U.S. Pat. No. 7,051,639 requires that an aperture be provided in the cylinder body. It would be advantageous to provide a sensor which could be retrofitted for use with existing cylinder bodies, without requiring modifications to the cylinder body and/or the cylinder gland.

SUMMARY OF THE INVENTION

One aspect of the present invention is directed to a cylinder assembly having a cylinder body, a gland member, a cylinder rod and a sensor. The cylinder body has a cylinder chamber which extends therein. The gland member is positioned at an end of the cylinder body and has a rod opening extending therethrough. A portion of the gland member is mounted in the cylinder chamber. The cylinder rod is movably arranged in the cylinder chamber and the rod opening. One or more detectable features are disposed along a length of the cylinder rod. A sensor is mounted on the gland member, the sensor being operable to read the one or more detectable features of the cylinder rod. A sensor receiving opening may be provided in the gland member; the sensor receiving opening extends from the rod opening in a radial direction to an outer wall of the gland member. A sensor housing mechanism may be provided in the sensor receiving opening. The sensor is mounted through an end surface of the sensor housing mechanism, such that a free end of the sensor extends beyond the end surface of the sensor housing mechanism.

In another aspect of the invention, an outer groove may be provided in a chamber wall of the cylinder chamber and an inner groove may be provided in the outer wall of the gland member. A mounting ring is positioned in the outer groove and inner groove to maintain the gland member in the cylinder chamber. The detectable features of the cylinder rod are positioned about the entire circumference of the cylinder rod, whereby if the gland member is rotated relative to the cylinder rod, the sensor will remain operable to read the detectable features.

In other aspects of the invention, the sensor receiving opening may be provided in a sensor mounting device that is mounted to the gland member. The sensor receiving opening extends from the rod opening in the sensor mounting device in a radial direction to an outer wall of the sensor mounting device. A mounting screw extends through the sensor mounting device into the gland member to secure the sensor mounting device to the gland member. Additionally, the sensor may be mounted in a seal that is mounted in the gland member.

Another aspect of the present invention is directed to a cylinder assembly having a cylinder body, a gland member, a cylinder rod and a sensor. The cylinder body has a cylinder chamber which extends therein. The gland member is positioned at an end of the cylinder body and has a rod opening extending therethrough. A portion of the gland member is mounted in the cylinder chamber. The cylinder rod is movably arranged in the cylinder chamber and the rod opening. One or more detectable features are disposed along a length of the cylinder rod. An adjustable sensor is mounted on the gland member, the adjustable sensor being operable to read the one or more detectable features of the cylinder rod. The adjustable sensor can be incrementally adjusted relative to the cylinder rod to optimize the gap provided between the adjustable sensor and the cylinder rod. A sensor receiving opening may be provided in the gland member; the sensor receiving opening extends from the rod opening in a radial direction to an outer wall of the gland member. A sensor housing mechanism may be provided in the sensor receiving opening. The adjustable sensor is mounted through an end surface of the sensor housing mechanism, such that a free end of the adjustable sensor extends beyond the end surface of the sensor housing mechanism.

In other aspects or the invention, the sensor receiving opening and the sensor housing mechanism have closely spaced threads which cooperate to maintain the sensor housing mechanism in the sensor receiving opening and which allow the sensor housing mechanism to be incrementally adjusted, thereby allowing the adjustment of the adjustable sensor relative to the cylinder rod. Additionally, at least one adjustment member may cooperate with a portion of the sensor housing mechanism which extends from the outer wall of the gland member. Adjustment of the adjustment member results in the adjustment of the adjustable sensor relative to the cylinder rod, thereby controlling the angular orientation of the adjustable sensor relative to the cylinder rod.

In another aspect of the invention, the sensor is operable to read the one or more detectable features of the cylinder rod in order to detect the motion and absolute position of the cylinder rod. The detectable features may be embedded in a magnetically hard layer on the cylinder rod. Three tracks of data may be provided on the cylinder rod. A first track includes first timing data and a second track includes second timing data. The first timing data and second timing data are positioned ninety degrees out of phase, thereby allowing the sensor to detect the direction of motion of the cylinder rod. A third track includes position data; the first timing data and the position data allow the sensor to determine the absolute position of the cylinder rod. The position data can be in the form of a non-repeating sequence or binary numbers.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
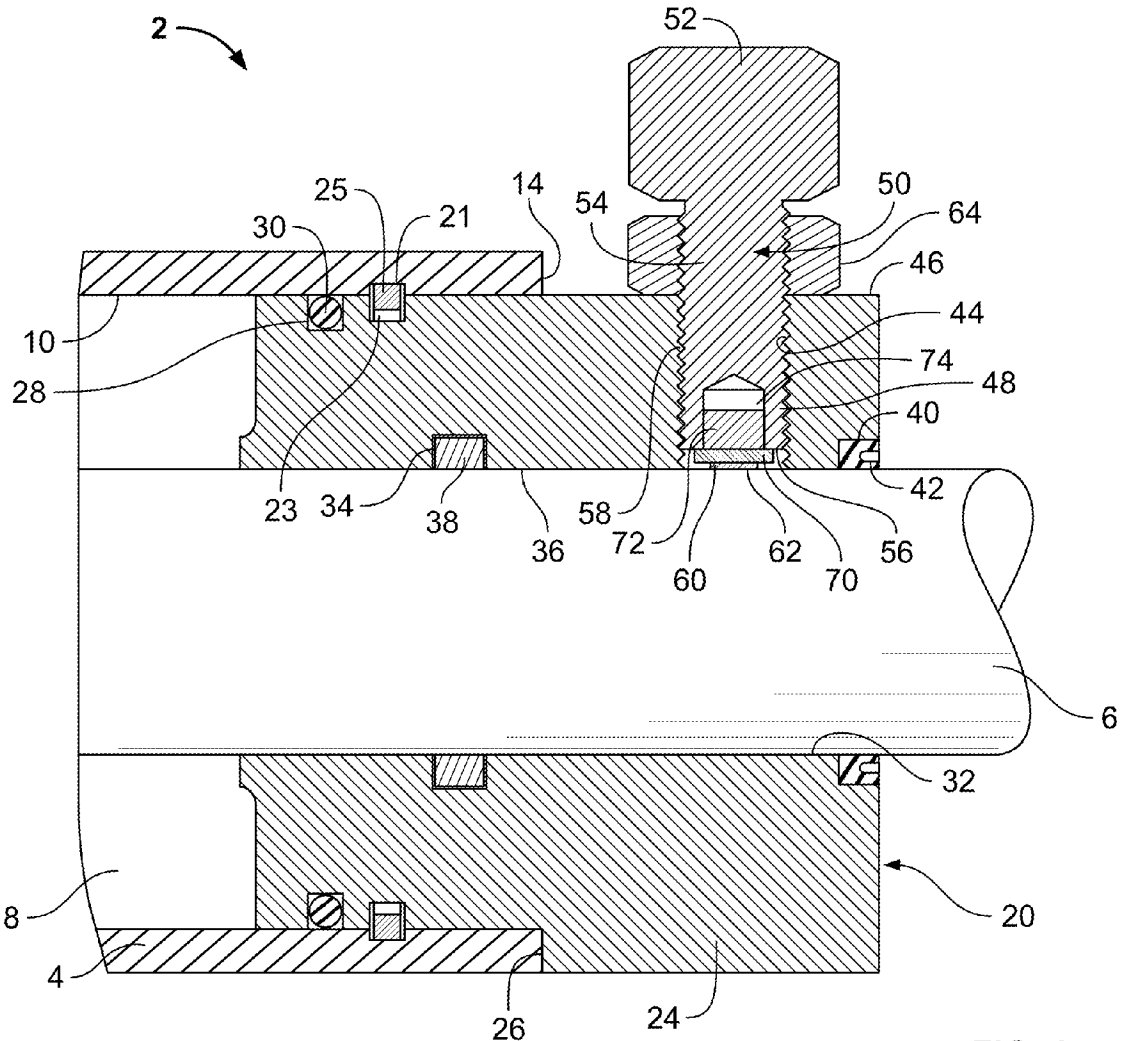
FIG. 1 is a cross-sectional view of a cylinder assembly according to a first embodiment of the invention showing an adjustable sensor mounted in a gland.

Referring to FIG. 1, a cylinder assembly 2 according to the present invention is shown. The cylinder assembly 2 has a cylinder body 4 with a cylinder rod 6 extending therein. The cylinder rod 6 may be connected to a piston (not shown) at the end of the cylinder rod 6 positioned in the cylinder body 4 and coupled (directly or indirectly) to a machine component (not shown) at the end of the cylinder rod 6 that extends out of the cylinder body 4.

The cylinder body 4 has a cylinder chamber 8 that extends longitudinally along the cylinder body 4. The cylinder chamber 8 has a chamber wall 10 extending about the circumference thereof.

A gland member 20 is positioned at the end of the cylinder body 4. As shown in FIG. 1, a portion of the gland member 20 is positioned within the cylinder chamber 8. A flange 24 extends from a portion of the gland member 20. A leading surface 26 of the flange 24 engages or is in close proximity to the end surface 14 of the cylinder body 4 when the gland member 20 is fully inserted in the cylinder body 4.

An outer groove 21 is provided in the chamber wall 10 of the cylinder chamber 8. An inner groove 23 is provided in the outer wall of the gland member 20. The outer groove 21 and inner groove 23 are positioned in alignment (as shown in FIG. 1) when the gland member 20 is properly inserted into cylinder chamber 8. A mounting ring 25 is positioned in grooves 21, 23. The mounting ring 25 provides retention between the cylinder body 4 and the gland member 20. As the gland member 20 is moved into the cylinder chamber 8, the mounting ring 25 will resiliently deform. When the mounting ring 25 is positioned in grooves 21, 23 the mounting ring 25 returns to its unstressed position, providing sufficient retention to maintain the gland member 20 in position. Other alternate means of retaining the gland member 20 in position relative to cylinder body 4, including threads or integral shoulder, can be used without departing from the scope of the invention A seal groove 28 may be provided along the outer surface of the gland member 20 proximate the inner groove 23. A seal 30 is provided in the seal groove 28. The seal 30 is resiliently deformed against the chamber wall 10 to provide a sealing engagement between the gland member 20 and the chamber wall 10 of the cylinder body 4.

A rod opening 32 extends through the gland member 20. The rod opening 32 extends along the longitudinal axis of the gland member 20 and is configured to receive the cylinder rod 6 therein. The rod opening 32 is dimensioned to allow the cylinder rod 6 to slide therethrough. A seal groove 34 may be provided in the gland member 20 along an inner wall 36 that defines the rod opening 32. A rod seal 38 is provided in the seal groove 34. The rod seal 38 is resiliently deformed against the cylinder rod 6 to provide a sealing engagement between the gland member 20 and the cylinder rod 6. Another seal groove 40 may be provided along the inner wall 36 of the gland member 20. A wiper seal 42 is provided in the seal groove 40. The wiper seal 42 is resiliently deformed against the cylinder rod 6 to provide a sealing engagement between the gland member 20 and the cylinder rod 6. The seals 38, 42 engage the cylinder rod 6 to keep the area of the cylinder rod between the seals 38, 42 free from debris or other substances.

A sensor receiving opening 44 is provided in the gland member 20. The opening 44 extends from an outer wall 46 of the gland member 20 to the inner wall 36. The opening 44 has a generally cylindrical configuration and extends from the rod opening 32 in a radial direction relative to the rod opening 32. An internal portion of opening 44 has a threaded area 48. However, in an alternative embodiment, opening 44 can define a non-cylindrical profile and may extend in a non-radial direction relative to the rod opening 32.

A sensor housing mechanism or bolt 50 is provided in opening 44. The bolt 50 has a head 52 and neck portion 54. The neck portion 54 extends from the head 52 to an end surface 56. Provided on the neck portion 54 proximate the end surface 56 are finely spaced threads 58. A sensor 60 is mounted through the end surface 56 of the neck portion 54. As best shown in FIG. 1, the sensor 60 is mounted to a circuit board 70. In the embodiment shown, the sensor 60 is reflow soldered to the circuit board 70, but other methods of mounting can be used. On the opposed face of the circuit board 70, a magnet 72 is mounted thereon, by glue or other means. The magnet 72, circuit board 70 and sensor 60 assembly is glued or otherwise mounted in an opening 74 provided in the bottom of the bolt 50. In this position, a free end 62 of the sensor 60 extends beyond the end surface 56 of bolt 50. A locking member or hex nut 64 is positioned around the circumference of the neck portion 54 of bolt 50 proximate the gland member 20. The hex nut 64 cooperates with the gland member 20 and bolt 50 to maintain the bolt 50 in the desired position relative to the gland member 20. While the particular bolt, hex nut and sensor assembly are shown and described, the particular configuration of these members can vary. Other types of sensor housing mechanisms, locking members and locking devices are known in the industry and can be substituted herein without departing from the scope of the invention.

Positioning the sensor 60 at the end surface 56 of bolt 50 allows the sensor to be positioned proximate the cylinder rod 6. In addition, as the bolt 50 has finely spaced threads 58 which cooperate with the finely spaced threads of threaded area 48 of opening 44, the positioning of the sensor 60 relative to the cylinder rod 6 can be incrementally adjusted to optimize the gap provided between the sensor 60 and cylinder rod 6.

Figure 2:
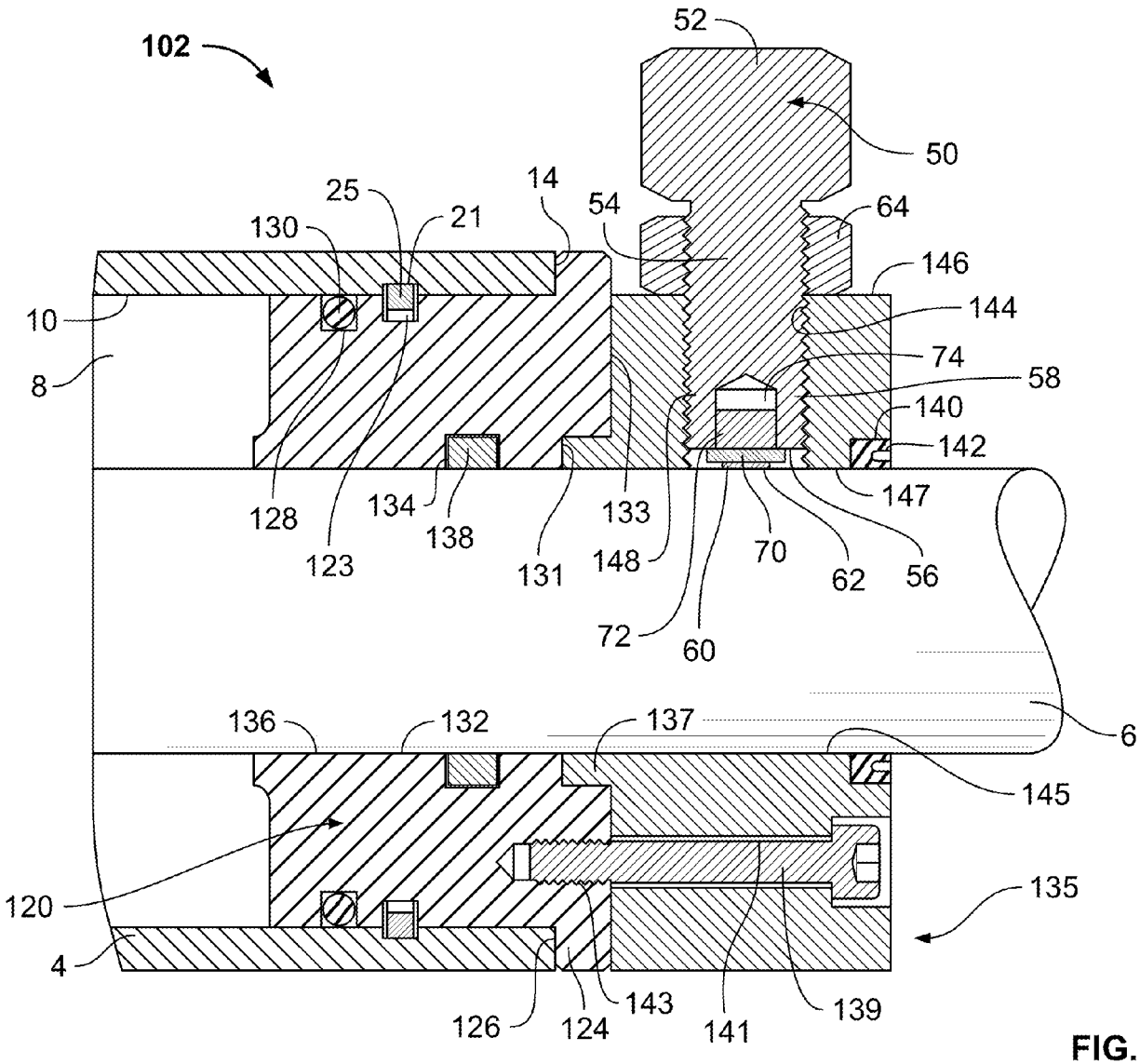
FIG. 2 is a cross-sectional view of a cylinder assembly according to a second embodiment of the invention showing an adjustable sensor mounted in a mounting device which is attached to a gland.

Referring to FIG. 2, an alternate embodiment of a cylinder assembly 102 according to the present invention is shown. In this embodiment, the cylinder body 4 and the cylinder rod 6 are essentially the same as in FIG. 1. A detailed description of these members will not be repeated, but the numbers will be carried forward for similar items.

A gland member 120 is positioned at the end of the cylinder body 4. As shown in FIG. 2, a portion of gland member 120 is positioned within the cylinder chamber 8. Outer groove 21, inner groove 123 and mounting ring 25 cooperate to maintain gland member 120 in position relative to the cylinder body 4. A peripheral flange 124 extends outward from the gland member 120. A leading surface 126 of the flange 124 engages or is in close proximity to the end surface 14 of the cylinder body 4 when the gland member 120 is fully inserted in the cylinder body 4. A circumferentially extending mating projection recess 131 is provided on a mating surface 133 of the gland member 120. On many existing gland members 120, the recess 131 is made by simply removing the previously installed wiper seal and using the seal groove as the recess 131.

A sensor mounting device 135 is configured to be attached to the mating surface 133 of the gland member 120. The sensor mounting device 135 has a circular mating projection 137 that is positioned in mating projection recess 131 when the sensor mounting device 135 is properly mounted to the gland member 120. The cooperation of the mating projection 137 and the mating projection recess 131 helps to ensure that the sensor mounting device 135 will be properly mounted to and properly seated in the gland member 120. A mounting screw 139 extends through an opening 141 formed in the sensor mounting device 135 to a threaded opening 143 of the gland member 120 to secure the sensor mounting device 135 to the gland member 120.

A seal groove 128 may be provided along the outer surface of the gland member 120. A seal 130 is provided in the seal groove 128. The seal 130 is resiliently deformed against the chamber wall 10 to provide a sealing engagement between the gland member 120 and the chamber wall 10 of the cylinder body 4.

A rod opening 132 extends through the gland member 120. The rod opening 132 extends along the longitudinal axis of the gland member 120 and is configured to receive the cylinder rod 6 therein. The rod opening 132 is dimensioned to allow the cylinder rod 6 to slide therethrough. A complimentary rod opening 145 extends through the sensor mounting device 135. The rod opening 145 extends along the longitudinal axis of the sensor mounting device 135 and is configured to receive the cylinder rod 6 therein. The rod opening 145 is dimensioned to allow the cylinder rod 6 to slide therethrough. A seal groove 134 may be provided in the gland member 120 along an inner wall 136 that defines the rod opening 132. A rod seal 138 is provided in the seal groove 134. The rod seal 138 is resiliently deformed against the cylinder rod 6 to provide a sealing engagement between the gland member 120 and the cylinder rod 6. Another seal groove 140 may be provided along the inner wall 147 of the sensor mounting device 135. A wiper seal 142 is provided in the seal groove 140. The wiper seal 142 is resiliently deformed against the cylinder rod 6 to provide a sealing engagement between the sensor mounting device 135 and the cylinder rod 6. The seals 138, 142 engage the cylinder rod 6 to keep the area of the cylinder rod between the seals 138, 142 free from debris or other substances.

An opening 144 is provided in the sensor mounting device 135. The opening 144 extends from an outer wall 146 of the sensor mounting device 135 to the inner wall 147. The opening 144 has a generally cylindrical configuration and extends from the rod opening 145 in a radial direction relative to the rod opening 145. An internal portion of opening 144 has a threaded area 148. However, in an alternative embodiment, opening 144 can define a non-cylindrical profile and may extend in a non-radial direction relative to the rod opening 145.

A sensor housing bolt 50 is provided in opening 144. The bolt 50 has a head 52 and neck portion 54. The neck portion 54 extends from the head 52 to an end surface 56. Provided on the neck portion 54 proximate the end surface 56 are finely spaced threads 58. A sensor 60 is mounted through the end surface 56 of the neck portion 54. As previously described with respect to the first embodiment, the sensor 60 is mounted to a circuit board 70. In the embodiment shown, the sensor 60 is reflow soldered to the circuit board 70, but other methods of mounting can be used. On the opposed face of the circuit board 70, a magnet 72 is mounted thereon, by glue or other means. The magnet 72, circuit board 70 and sensor 60 assembly is glued or otherwise mounted in an opening 74 provided in the bottom of the bolt 50. In this position, a free end 62 of the sensor 60 extends beyond the end surface 56 of bolt 50. A hex nut 64 is positioned around the circumference of the neck portion 54 of bolt 50 proximate the sensor mounting device 135. The hex nut 64 cooperates with the sensor mounting device 135 and bolt 50 to maintain the bolt 50 in the desired position relative to the sensor mounting device 135.

Positioning the sensor 60 at the end surface 56 of bolt 50 allows the sensor to be positioned proximate the cylinder rod 6. In addition, as the bolt 50 has finely spaced threads 58 which cooperate with the finely spaced threads of threaded area 148 of opening 144, the positioning of the sensor 60 relative to the cylinder rod 6 can be incrementally adjusted to optimize the gap provided between the sensor 60 and cylinder rod 6.

Figure 3:
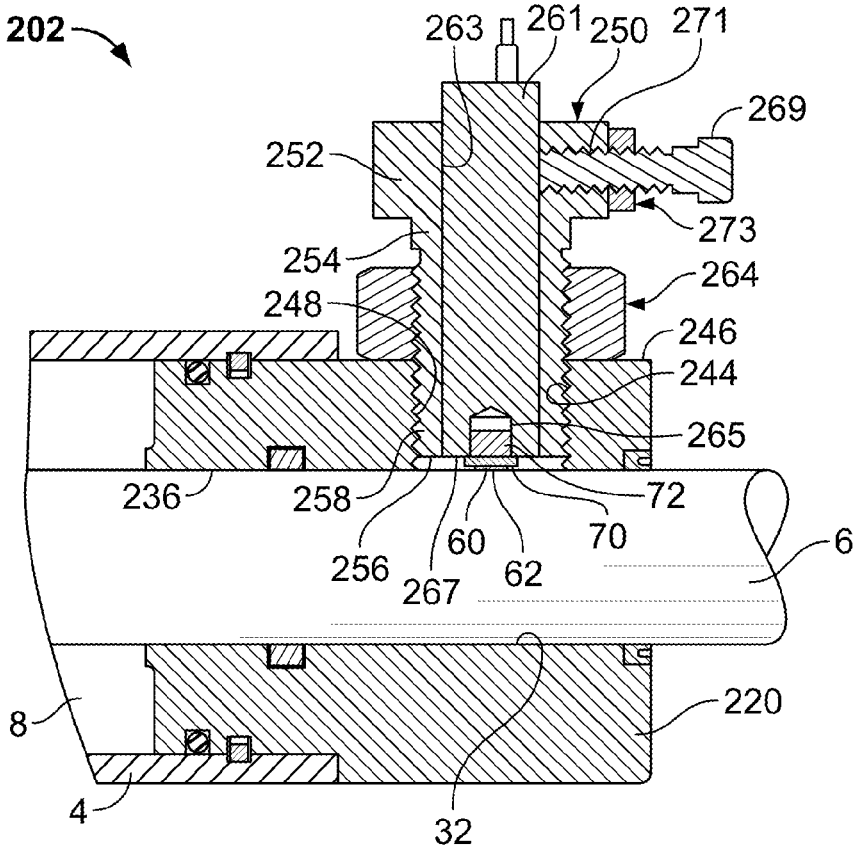
FIG. 3 is a cross-sectional view of a cylinder assembly according to a third embodiment of the invention showing an alternate embodiment of an adjustable sensor mounted in a gland.

Referring to FIG. 3, another alternate embodiment of a cylinder assembly 202 according to the present invention is shown. In this embodiment, the cylinder body 4, the cylinder rod 6 and the gland member 20 are essentially the same as in FIG. 1. A detailed description of these members will not be repeated, but the numbers will be carried forward for similar items.

An opening 244 is provided in the gland member 20. The opening 244 extends from an outer wall 246 of the gland member 20 to the inner wall 236. The opening 244 has a generally cylindrical configuration and extends from the rod opening 32 in a radial direction relative to the rod opening 32. An internal portion of opening 244 has a threaded area 248. However, in an alternative embodiment, opening 244 can define a non-cylindrical profile and may extend in a non-radial direction relative to the rod opening 32.

A sensor housing bolt 250 is provided in opening 244. The bolt 250 has a head 252 and neck portion 254. The neck portion 254 extends from the head 252 to an end surface 256. Provided on the neck portion 254 proximate the end surface 256 are finely spaced threads 258. A sensor 60 is mounted through the end surface 267 of the sensor rod assembly 261. As best shown in FIG. 3, a sensor rod assembly 261 extends through a longitudinally extending opening 263 formed in bolt 250. The sensor 60 is retained in a cavity 265 provided at an end surface 267 of the sensor rod assembly 261. The end surface 267 of the sensor rod assembly 261 is provided in alignment with the end surface 256 of the bolt 250. As previously described, the sensor 60 is mounted to a circuit board 70. On the opposed face of the circuit board 70, a magnet 72 is mounted thereon. The magnet 72, circuit board 70 and sensor 60 assembly is mounted in the cavity 265 provided in the sensor rod assembly 261. In this position, a free end 62 of the sensor 60 extends beyond the end surface 267 of the sensor rod assembly 261 and the end surface 256 of bolt 250. A hex nut 264 is positioned around the circumference of the neck portion 254 of bolt 250 proximate the gland member 20. The hex nut 264 cooperates with the gland member 20 and bolt 250 to maintain the bolt 250 in the desired position relative to the gland member 20.

An adjustment member or threaded set screw 269 extends through a threaded opening 271 provided in the head 252 of bolt 250. The opening 271 and set screw 269 extend in a direction that is essentially perpendicular to the opening 263. A hex nut 273 cooperates with the head 252 and the set screw 269 to maintain the set screw 269 in the desired position. Although only one set screw 269 is shown, two or more set screws may be provided and spaced about the circumference of the head 252.

Positioning the sensor 60 at the end surface 256 of the bolt 250 allows the sensor to be positioned proximate the cylinder rod 6. In addition, as the bolt 250 has finely spaced threads 258 which cooperate with the finely spaced threads 248 of opening 244, the positioning of the sensor 60 relative to the cylinder rod 6 can be incrementally adjusted to optimize the gap provided between the sensor 60 and cylinder rod 6. Adjusting the set screw or set screws 269 may result in the adjustment of the sensor rod assembly 261 and the sensor 60 attached thereto, thereby helping to control the angular orientation and sensitivity direction of the sensor.

Figure 4:
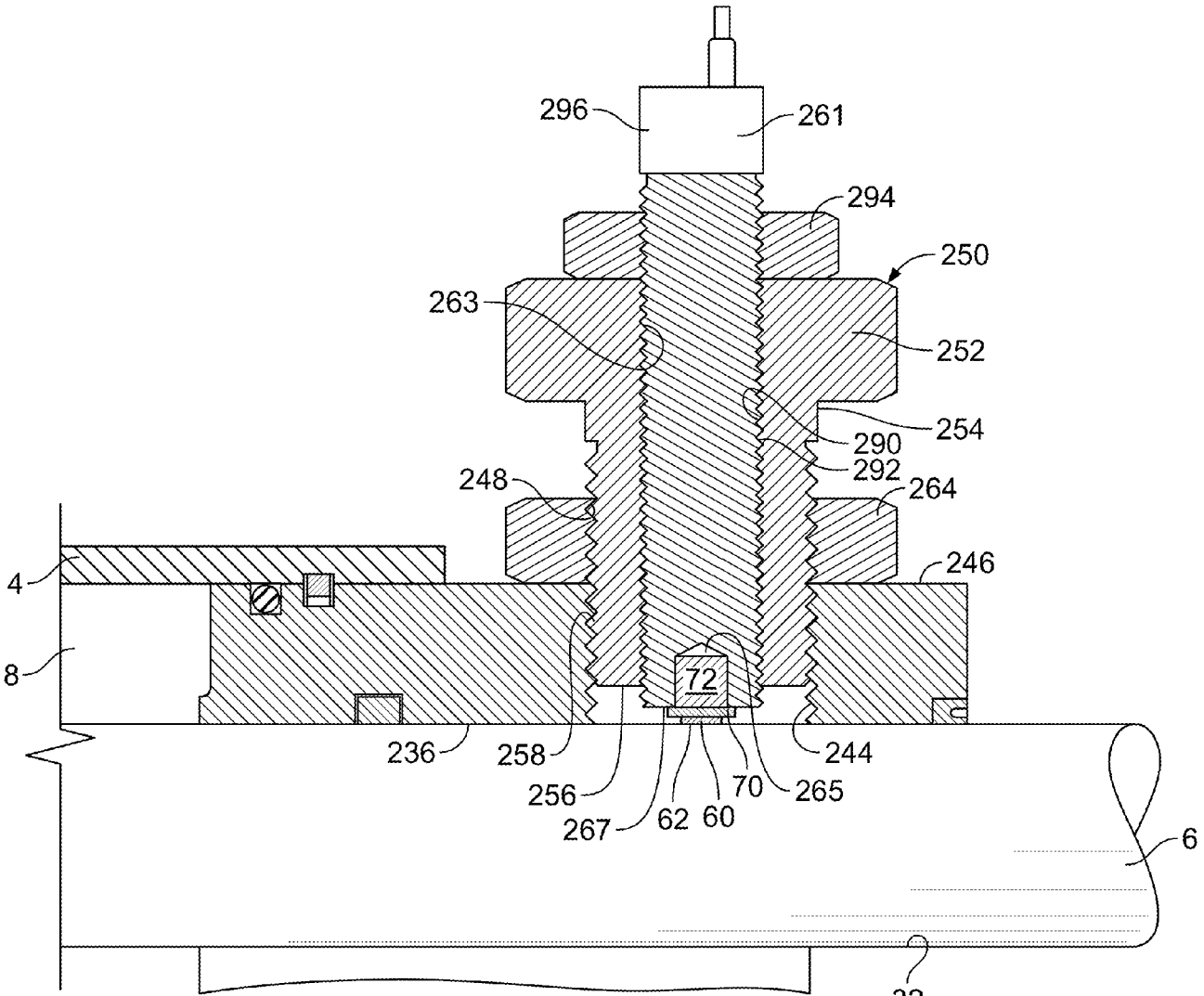
FIG. 4 is a cross-sectional view of a cylinder assembly according to a fourth embodiment of the invention showing an alternate embodiment of an adjustable sensor mounted in a gland.

Referring to FIG. 4, an embodiment similar to that of FIG. 3 is shown. In this embodiment, the set screw 269 and hex nut 273 have been eliminated. In order to provide the sensor 60 with the correct angular orientation, the sensor rod assembly 261 has been provided with finely spaced threads 290 which cooperate with finely spaced threads 292 provided around the opening 263. Threads 290, 292 have a different thread pitch than threads 248, 258, thereby allowing the position of the sensor to be more precisely controlled. The difference in pitches between the threads allows for much greater control in the adjustment of the sensor 60, thereby allowing the sensor 60 be independently placed in proper angular alignment and placed in proper position relative to the cylinder rod 6 to optimize the gap provided between the sensor 60 and the cylinder rod 6.

A hex nut 294 is positioned about the rod assembly 261 proximate the head 252 of the sensor housing bolt 250. The hex nut 294 cooperates with the head 252 to maintain the rod assembly 261 in proper position. A tool engagement area 296 on the rod assembly 261 is provided proximate the hex nut 294. The tool engagement area 296 allows an operator to properly position and maintain the rod assembly 261 in position as the hex nut 294 is tightened.

Figure 5:
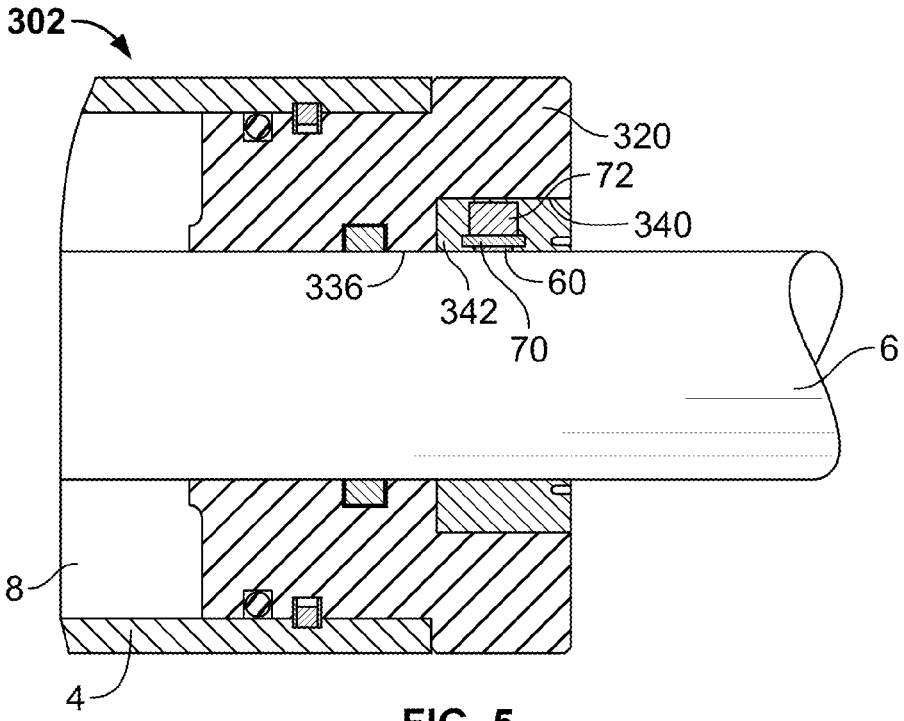
FIG. 5 is a cross-sectional view of a cylinder assembly according to a fifth embodiment of the invention showing a sensor mounted in a gland.

Referring to FIG. 5, another alternate embodiment of a cylinder assembly 302 according to the present invention is shown. In this embodiment, the cylinder body 4 and the cylinder rod 6 are the essentially the same as in FIG. 1. A detailed description of these members will not be repeated, but the numbers will be carried forward for similar items.

A generally cylindrical gland member 320 is positioned at the end of the cylinder body 4. As shown in FIG. 5, a portion of gland member 320 is positioned within the cylinder chamber 8. As the gland member 320 has many of the same features as the gland member 220, this description will focus on the differences between gland member 320 and gland member 220.

A seal groove 340 may be provided along the inner wall 336 of the gland member 320. A wiper seal 342 is provided in the seal groove 340. The wiper seal 342 is resiliently deformed against the cylinder rod 6 to provide a sealing engagement between the gland member 320 and the cylinder rod 6. A sensor 60 is provided in the wiper seal 342. In this embodiment, the manufacturing tolerances of the seal groove 340, wiper seal 342 and sensor 60 must be properly controlled to ensure that the sensor 60 is properly positioned relative to the cylinder rod 6.

Figure 6:
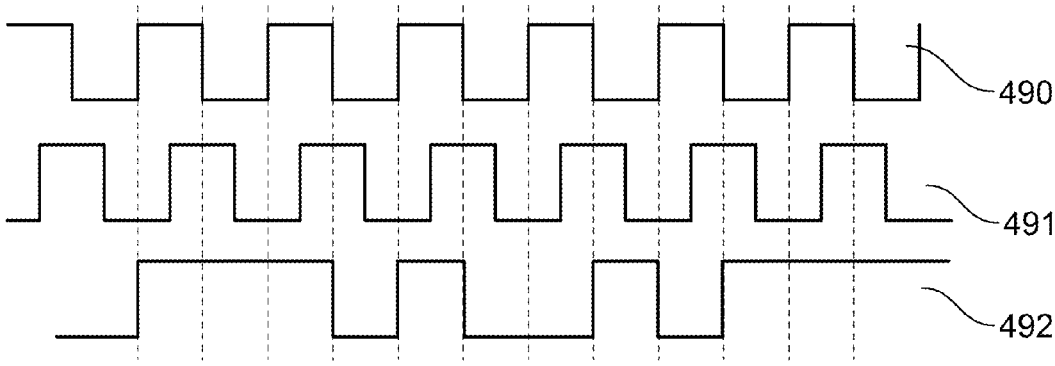
FIG. 6 is a two-dimensional view of a signal diagram of three data tracks which are embedded near the surface of a cylinder rod, the signal diagram indicating cylinder rod extension.
Figure 7:
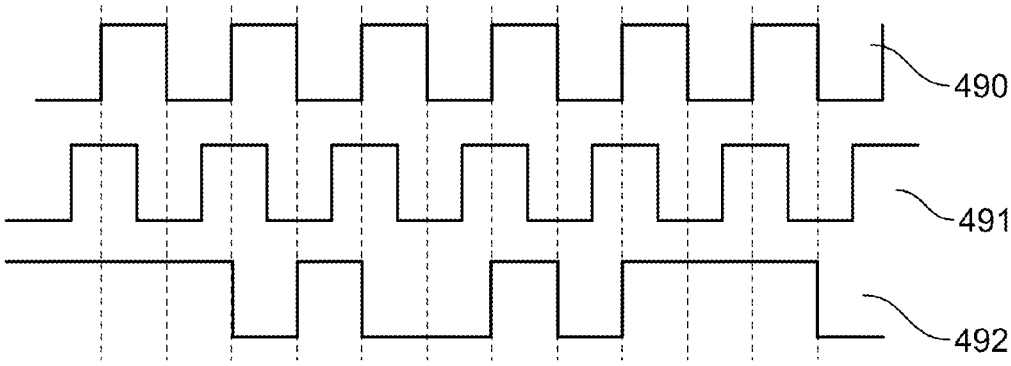
FIG. 7 is a two-dimensional view of a signal diagram of three data tracks which are embedded near the surface of a cylinder rod, the signal diagram indicating cylinder rod retraction.

The cylinder rod 6 has a coating in which discrete signals can be positioned or embedded. The discrete signals can include binary data, data containing 'hi-lo' or '0-1' information, or such other data. The signals can be recorded in a magnetically hard layer on the cylinder rod 6 or in any other known manner. Alternatively, the discrete signals can be provided on the cylinder rod 6 in any number of ways that allow the signals to be detectable by the sensor 60. Referring to FIGS. 6 and 7, three data tracks are recorded or embedded on the cylinder rod 6. The three tracks are first timing data 490, second timing data 491, and position data 492.

As shown in FIGS. 6 and 7, first timing data 490 and second timing data 491 are ninety degrees out of phase. However, the timing data my be out of phase an amount different than ninety degrees. As the sensor 60 reads the signals from the first timing data 490 and the second timing data 491, the sensor reads in which order they go 'hi-lo' or 'lo-hi' and when they are both 'lo' or 'hi'. By so doing, the direction of motion of the cylinder rod 6 can be determined. As an example, the first timing data 490 and the second timing data 491 shown in FIG. 6 indicate the cylinder rod 6 is extending, while the first timing data 490 and the second timing data 491 shown in FIG. 7 indicate the cylinder rod 6 is retracting.

The position data 492 can be in the form of a binary number or a non-repeating, random sequence. The sensors 60 can read the signals from the first timing data 490 and the position data 492 to determine the absolute position of the cylinder rod 6. Using the first timing data 490 as a clock, the signals from the position data 492 can be accurately read. When compared to information stored in memory, the readings can be used to determine the absolute position of the cylinder rod 6. Consequently, as the absolute position is determined, rather than a relative position, no reference point need be established. The position data 492 can include sequences denoting start-bit, end-bit, breakers between data, direction data, etc.

Figure 8:
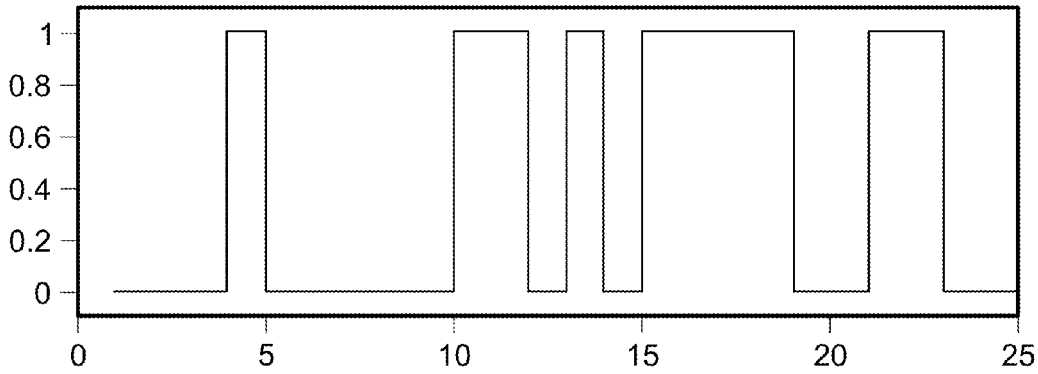
FIG. 8 is a two-dimensional view of a non-symmetric binary code which is embedded near the surface of a cylinder rod.
Figure 9:
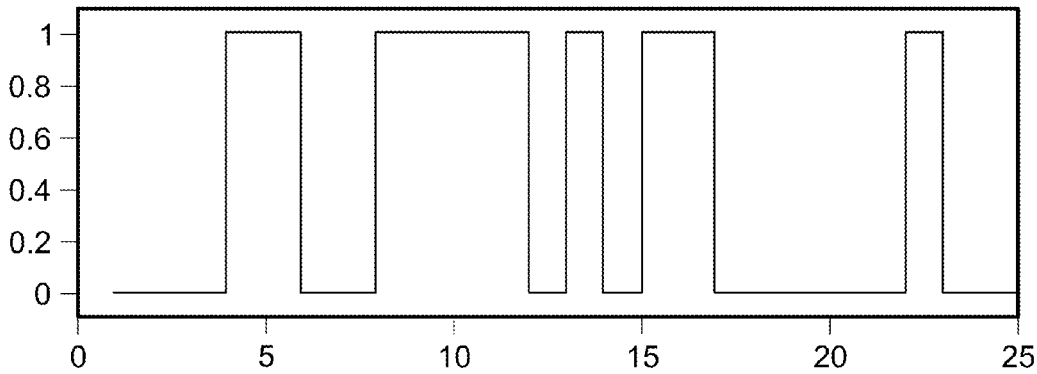
FIG. 9 is a two-dimensional view of a non-symmetric binary code which is embedded near the surface of a cylinder rod indicating the cylinder rod is retracting.

For sensors 60 to properly read the signals from first timing data 490, second timing data 491 and position data 492, the sensors 60 must be aligned with the tracks on the cylinder rod 6 in which the information is embedded. Alternatively, if the information is embedded in a nonsymetric binary code (as shown in FIGS. 8 and 9) or the like around the entire circumference of the cylinder rod 6, the sensor 60 must not be accurately positioned. In this circumstance, the sensor 60 could be free to move or rotate about the cylinder rod 6. As an example, the nonsymetric binary code shown in FIG. 8 indicates the cylinder rod 6 is extending, while the nonsymetric binary code shown in FIG. 9 indicates the cylinder rod 6 is retracting.

In the first alternative, in which the sensor 60 must be aligned, the gland must be maintained in position relative to the cylinder body. Many ways are conceived to accurately align and maintain the gland, and ultimately the sensor, in position. A set screw could extend through the cylinder body 4 and engage a set screw receiving area of the gland to ensure proper position. Alternatively, a keying projection could extend from the cylinder body 4. The keying projection would cooperate with a keying recess of the gland to allow the gland to be inserted into the cylinder body in only one position. Other known methods could also be used. With the sensor 60 accurately positioned and maintained, the cylinder rod 6 must be properly and accurately inserted so that the tracks with the data 490, 491, 492 are positioned in line with the sensor 60. In the embodiment shown in FIG. 3, the cylinder rod 6 and sensor 60 may be slightly misaligned, as the sensor rod assembly 261 can be adjusted to control the angular orientation and sensitivity of the sensor 60.

In the second alternative, where the data is embedded about the entire circumference of the cylinder rod 6, the gland may rotate or move relative to the cylinder rod 6, without affecting the operation of the sensor. As the data 490, 491, 492 can be read from any point around the circumference of the cylinder rod 6, the initial position or the continuing position of the sensor 60 relative to a particular track of the cylinder rod 6 is not critical.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A cylinder assembly comprising:

a cylinder body having a cylinder chamber extending therein;

a gland member having a rod opening extending therethrough, the gland member positioned at an end of the cylinder body, a portion of the gland member is mounted in the cylinder chamber;

a cylinder rod movably arranged in the cylinder chamber and the rod opening, the cylinder rod having detectable features disposed along a length of the cylinder rod;

a sensor mounted in a seal that is mounted in the gland member.

2. The cylinder assembly of claim 1 wherein the seal and sensor are mounted in a groove with an inner wall of the gland member adjacent a surface of the cylinder rod.

3. The cylinder assembly of claim 1 wherein the detectable features are at least three tracks of data provided on the cylinder rod.

4. The cylinder assembly of claim 3 wherein a first track includes first timing data and a second track includes second timing data, the first timing data and second timing data being positioned out of phase, thereby allowing the sensor to detect the motion of the cylinder rod.

5. The cylinder assembly of claim 4 wherein a third track includes position data, the first timing data and the position data allow the sensor to determine the absolute position of the cylinder rod.

6. The cylinder assembly of claim 1 wherein the detectable features are in the form of binary numbers.

7. The cylinder assembly of claim 1 wherein the detectable features are in the form of a non-repeating sequence.

* * * * *